United States Patent [19]

Townsend

[11] Patent Number: 4,548,584

[45] Date of Patent: Oct. 22, 1985

[54] COMPUTER CONTROLLED MOBILE DEVICE

[75] Inventor: Max F. Townsend, Barnsley, England

[73] Assignee: Economatics (Education) Limited, Sheffield, England

[21] Appl. No.: 569,035

[22] Filed: Jan. 9, 1984

[30] Foreign Application Priority Data

May 10, 1983 [GB] United Kingdom ..... 8312810

[51] Int. Cl.[4] ..... G09B 19/00

[52] U.S. Cl. ..... 434/118; 446/95; 446/146; 446/454; 446/456

[58] Field of Search ..... 434/118, 433; 446/95, 446/120, 124, 146, 436, 454, 455, 456

[56] References Cited

U.S. PATENT DOCUMENTS

| | | | |
|---|---|---|---|
| 4,164,090 | 8/1979 | Fischer | 446/95 |
| 4,168,468 | 9/1979 | Mabuchi et al. | 446/454 X |
| 4,248,011 | 2/1981 | Shimamura | 446/456 |

FOREIGN PATENT DOCUMENTS

| | | |
|---|---|---|
| 003561 | 12/1981 | European Pat. Off. . |
| 0044773 | 1/1982 | European Pat. Off. . |
| 3137077 | 5/1982 | Fed. Rep. of Germany . |
| 1094418 | 12/1967 | United Kingdom . |
| 1094419 | 12/1967 | United Kingdom . |
| 2006495 | 5/1979 | United Kingdom . |
| 2023893 | 1/1980 | United Kingdom . |

OTHER PUBLICATIONS

*Byte* vol. 2, No. 6, Hollis, 6-1977.

*Primary Examiner*—William H. Grieb
*Attorney, Agent, or Firm*—William R. Hinds

[57] ABSTRACT

A mobile device to be connected to a home microcomputer is arranged to facilitate and encourage experimentation by the user. The device is largely made from construction kit ports, facilitating modifications and additions to its structure. Drive is provided by stepper motors, with one digital output pulse from the computer causing one increment of motor rotation. This simplifies programming by the user, especially if one pulse is arranged to cause a turn through an integer fraction of a right angle. The device carries a circuit board to which sensors on the device are connected by individual plugs and sockets, enabling one to be disconnected without disturbing the others. An interface board intermediately between the mobile device and the computer collates several cables from the computer parts into one cable leading to the mobile device.

22 Claims, 10 Drawing Figures

48
53
57
104
105
0V(POWER)
64
65
66
67
Z
C1
0V(SIGNAL)
R
0V(POWER)
12V
5V
50
52
5V
54
51
55
56
CH3
CH2
CH1
CH0
CB2
CB1
PB7
PB6
PB5
PB4
PB3
PB2
PB1
PB0
60
49
61
62
60'
61'
62'

73L
73R
TR
12V
5V
C2
0V POWER
0V SIGNAL
PB0
PB1
PB2
PB3
PB4
PB5
PB6
PB7
CH2/CB1
CH3/CB2
CH0
CH1

COMPUTER CONTROLLED MOBILE DEVICE

FIELD OF THE INVENTION

This invention relates to a motorised mobile device to be controlled by a computer.

The invention is particularly intended to be employed in an educational device arranged to receive command signals from a separate, user-progammable microcomputer. Such a device would serve to give practical experience of programs to control slave machines.

BACKGROUND OF THE INVENTION

There have been various mobile, computer-controlled devices constructed or prepared. Many have been one-off devices, built as hobby projects, research projects and the like.

SUMMARY OF THE INVENTION

The invention seeks to provide a device which can be made in quantity, commercially, and yet will facilitate, and perhaps even encourage, experimentation by the user.

This invention provides a mobile device with a chassis supported on a pair of driving wheels, and stepper motors to provide drive, with the chassis being constructed from, or at any rate compatible with, construction kit parts.

Stepper motors facilitate user programming of the computer, because a simple output pulse from the computer, or group of pulses on a few lines, can operate motor(s) to accomplish an advance, or turn by a known amount. Preferably simplicity is enhanced by arranging that one pulse, or set of pulses turns the device through an integer fraction of a circle, i.e. 360°/n where n is an integer.

Preferably n is 360, so that a signal or set of signals will turn the device by 1°. However n could be some other value, notably 180 or 720 so that the device turns by 2° or ½° steps. It is desirable that n is divisible by 4, to make right angle turns possible.

This use of stepper motors presents the computer user with a simple arrangement, which in preferred forms gives a simple relationship between digital signals and degrees of turn. Consequently the user should not have difficulty in achieving basic movements of the device, and will be free to concentrate on programming to effect sequences of movements.

In a preferred arrangement a digital signal or set of signals from the computer causes rotation through one increment, but a conceivable alternative is that a signal from the computer starts rotation, whereafter the computer counts digital signals returned by the circuitry as the motor(s) increment, and gives a second signal to stop rotation after the appropriate number of signals indicating increments have been returned.

Either way, it is desirable that increments of the motor(s) should be associated with a digital signal or set of digital signals which is repeated for subsequent increments—preferably being repeated for each increment.

With the preferred, two motor arrangement, one possibility is that a single digital signal should cause a single motor to turn through a single increment. A second signal can determine direction of motor revolution. Other signal arrangements are conceivable however. For example, one signal could command both motors to turn through one increment, with separate signals defining direction of turn. Another possibility is that signals for each motor could merely define the number of increments of turn required and the direction, with a further signal initiating the defined action.

Preferably the driving wheels are on a common axis, so that the motors can turn the device about the centre of that axis. A pen may be fitted at that point in order that the device can act as a so-called "logo" able to draw while manoeuvering on a sheet of paper, with the pen able to stay at a fixed point during turns.

The use of stepping motors to effect linear drive is also advantageous, because it readily enables the user to command the device to move through a fixed distance.

Signals causing the circuitry to increment a stepper motor may be voltage pulses, and the circuitry may conveniently respond to the leading edge of a pulse.

Compatibility with construction kit parts is another feature which encourages user experimentation by making it possible to modify or add further parts onto the chassis structure without permanently damaging or destroying it.

Construction kits are characterised by an ability to assemble their parts releasably, permitting dismantling and re-use of the components. They are also characterised by an ability to assemble components together in a plurality of different positions. This is generally made possible by attachment formations of some kind which are either arranged at a regular spacing in lines or arrays, or else are arranged to extend continuously, permitting attachment at any point along the length.

For example the construction kit system sold under the Trade Mark "Lego" uses projecting studs in uniformly spaced lines and two dimensional arrays. Further parts press fit over these studs.

Another construction kit system is sold under the Trade Mark "Meccano". It has uniformly spaced bolt holes in lines and arrays. The manufacturer is Miro-Meccano, 118–130 Avenue Jean-Jaures, 75942 Paris Cedex 19, France.

The preferrred construction kit is the system sold under the Trade Mark "Fischertechnik" whose parts engage together by means of continuous undercut grooves into which other parts can engage. Basic parts for this system are described in U.K. Pat. Nos. 1 094 418 and 1 094 419 the disclosures of which are incorporated herein by reference.

A further feature encouraging experimentation is to arrange that various sensing devices (e.g. contact switches, tilt switches, bar code readers) connect through separate and preferably individual, electrical connectors, so that some can be disconnected, and replaced by others.

According to a further aspect of this invention a mobile device has stepper motors for propulsion and turning with a geometrical arrangement such that when the said stepper motor(s) rotate through one angular increment, the motor(s) turn the device through a predetermined angle of 360°/n where n is an integer, the operating circuitry permitting the computer to effect and control rotation of the stepper motor(s) through any arbitrary number of increments as may be required.

The mobile device may carry a circuit board with the various electrical connectors mounted on it.

In another aspect of the invention, a second board is used to provide a static interface unit connectible to the computer and to the circuit board on the mobile device. Such a unit can be provided with cables for simultaneous connection to a plurality of ports on a computer, and a cable for connection to the mobile device.

DESCRIPTION OF PREFERRED EMBODIMENTS

The mobile device has a chassis structure built up from construction kit parts. These parts belong to the system sold under the Trade Mark "Fischertechnik" and the basic block used in that system is the subject of U.K. Pat. No. 1 094 418.

Figure 1:
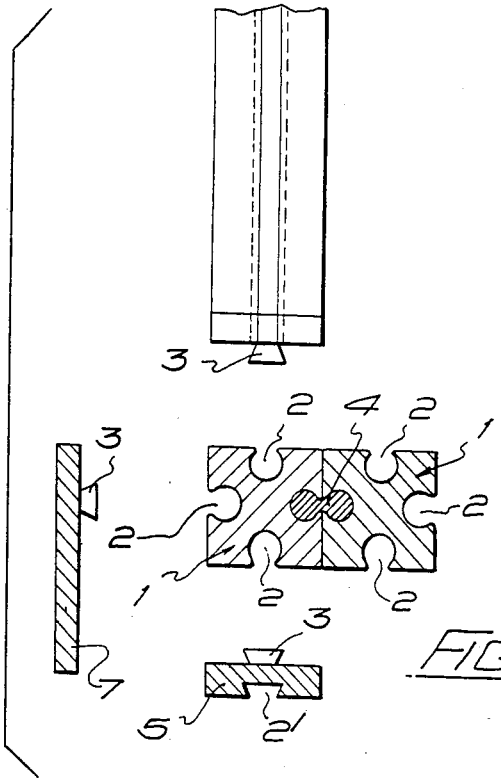
FIG. 1 is a diagrammatic representation of parts from the Fischertechnik system.
Figure 2:
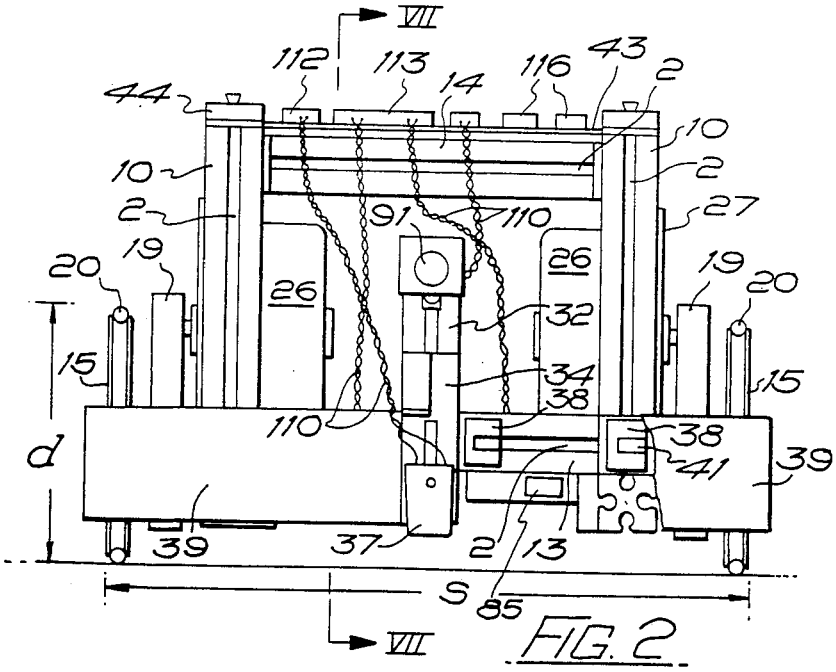
FIG. 2 is a front elevation of the mobile device, with one bumper cut away.
Figure 3:
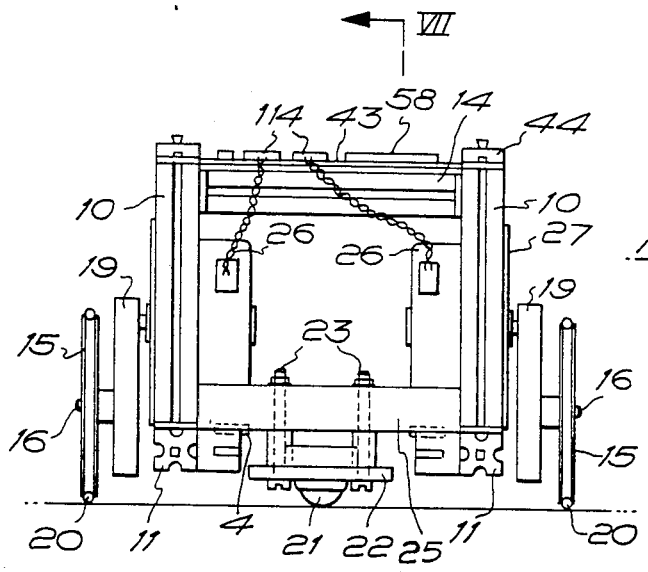
FIG. 3 is a rear elevation of the device.

FIG. 1 illustrates basic parts from the system. It employs blocks and bars of various lengths having a standard square section 1, with an elongate undercut groove 2 running along each face. At one or both ends such blocks terminate in a projection 3, centrally positioned on the end face, and having a dovetail shape which can be slid into a groove 2, to form an end-to-side connection. Blocks can be joined side to side with links 4 of FIG. 8 cross section slid into the confronting grooves.

Blocks may have a groove across one end face as shown at 5.

Various other parts are available, and connect by means of such projections and undercuts. One example is the short brick 6, having a dovetail undercut groove 2', across one flat face and a projection 3 on the other. Another example is a plate 7, with a row of projections 3 on one face.

These parts all form a commercially available system and therefore will not be described in further detail. The manufacturer is Fischer-werke Artur Fischer GmbH & Co KG D 7244 Tumlingen/Waldachtal, Germany.

STRUCTURAL ARRANGEMENT

The chassis structure is shown in FIGS. 2 to 7. It is an approximately cubical frame built up from bars 10–14 having the cross section 1 and releasably joined together by engagement of end projections (like 3 above) into undercut grooves 2, in the manner described above. A number of shorter blocks are attached to these bars by means of links (as 4 above) and/or the projection into groove form of connection.

The chassis structure is supported on a pair of driving wheels 15 and a rear castor, in tricycle arrangement. The driving wheels 15 are mounted on respective half shafts 16 held in undercut grooves 17 across the ends of blocks 18 (FIG. 5) on the lower horizontal bars 11. Axially inwardly of each wheel is a sprocket fixed to the wheel 15 and meshing with chain 19 to drive it. Each wheel 15 a pulley fitted with rubber O-ring 20. By virtue of the convexity of the O-ring, the area of each O-ring which will contact a hard floor is quite small.

The rear caster is a large ball bearing 21 captive in a socket 22, held in place by bolts 23 passing through slots in the confronting end faces of a pair of blocks 24 (FIG. 6) which extend in horizontally from each side of the chassis and are connected to a plate 25 which extends across the rear of the chassis.

The mobile device is propelled by a pair of stepper motors 26 one at each side. These have integral mounting plates 27 which project beyond the motor casing and are bolted to grooves 28 in blocks 29, 30 which are connected into the upper and lower horizontal bars 12, 11 at each side, and are also connected directly or indirectly to the adjacent upright bars 10.

Each motor shaft carries a sprocket 31 meshing with the chain 19, to drive the associated wheel 15.

The lower bar 13 which extends across the front of the chassis supports, at its middle, an upright block 32 on the top of which is mounted a block 33 with a light dependent resistor 91 on its forward face. This block 33 is a standard Fischertechnik part. An arm 34, made up from several blocks and incorporating a central hinge 35 is connected onto the front face of the block 32. The outer part of arm 34 has a bar code reader 37 bolted to it.

The horizontal bar 13 and the front corner uprights carry hinges 38 on which are mounted plates 39 which form bumpers, one at each side of the front. These normally have the inclined position shown, but on striking an obstacle they pivot about a horizontal axis at the top of their hinges, so that small blocks 40 behind the plates 39 operate microswitches 85 carried on the underside of the bar 13. The hinges 38 have projections by which they are mounted onto the undercut groove 2 on the front of bar 13, and themselves have undercut grooves 41 to be engaged by projections on the rear of the plates 39.

The structure so far described is built up almost entirely from construction kit parts, which could if desired be dismantled and put together in other ways. Undercut grooves 2 are exposed on numerous faces of the chassis, and so additional parts could be added on to the chassis structure. All this facilitates experimentation by the user. On top of the chassis is a printed circuit board 43 on which are mounted various electrical and electronic components, to be described below. The board has corners which are shaped to fit round the tops of upright bars 10. It is held in place by small blocks 44 connected to the tops of the upright bars 10, but offset to overlie the corners of the printed circuit board 43.

Figure 7:
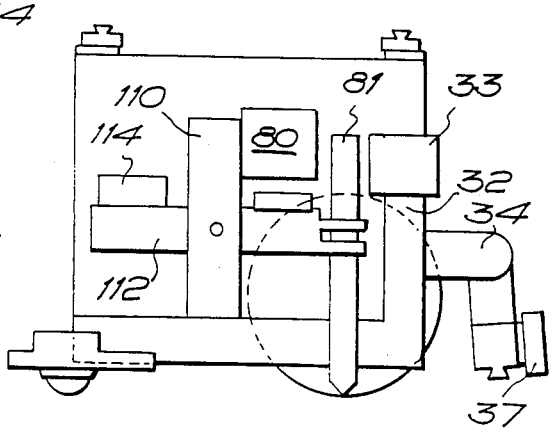
FIG. 7 is a diagrammatic section on line VII—VII of FIGS. 2 and 3 diagrammatically illustrating the pen holder location with the front bumper omitted.

As shown by FIG. 7, an upright 110 has a beam 112 pivoted on it. The beam supports the pen 81 at one end. It is arranged that the pen will drop under the force of gravity to write. A solenoid 80 is supported on the upright 110 and when energised the solenoid will pull the pen up, so that it no longer contacts the surface below. A balancing weight 114, serving to counterbalance the weight of ink in the pen reservoir, may be altered or removed as necessary.

When it is not desired to draw as the device moves the pen 81 is raised and held by a fastening (not shown) in the raised position. When it is desired to draw with the device the pen is unfastened, the device placed on a sheet of paper, and the solenoid 80 is energised and de-energised as will be described below to raise and lower the pen 81 as required.

When lowered the pen 81 will write as the mobile device moves, and for this function the device would of course be made to run over a sheet of paper.

As an alternative to the tilting beam 112, the pen 81 could be mounted on a vertical slide and moved up and down on it by a solenoid. This would be connected electrically exactly as is the illustrated solenoid 80..

DRIVE AND WHEEL GEOMETRY

The driving wheels 15, and the rear caster 21 give a tricycle arrangement so that if the motors are driven to turn both wheels 15 together the whole mobile structure will be propelled linearly forwards or backwards but if one wheel is driven forward while the other wheel is driven backward by a corresponding amount the device will turn about the central point 47 between the wheels 15.

Figure 4:
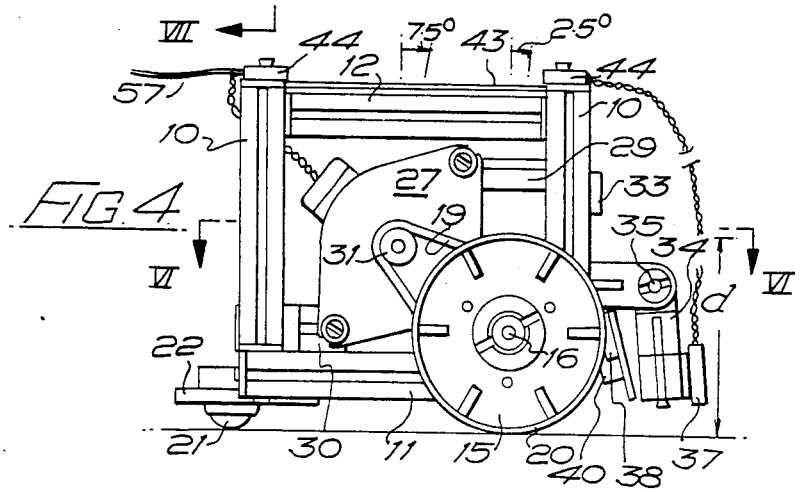
FIG. 4 is a side elevation of the device.
Figure 5:
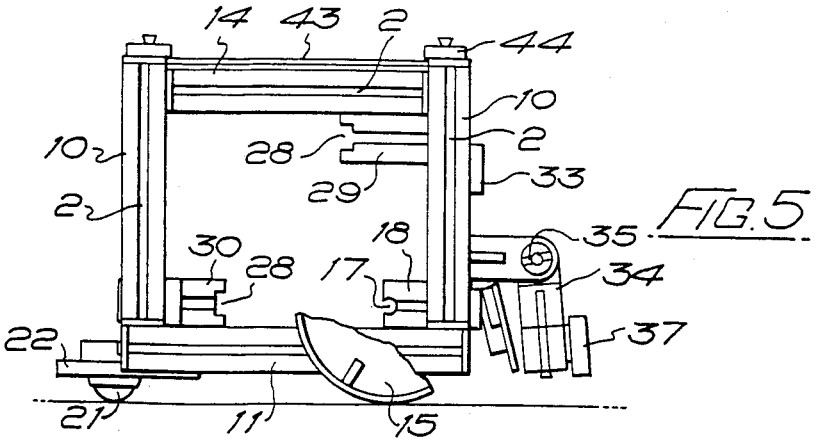
FIG. 5 is a repeat of the side elevation, with parts omitted to reveal the motor and axle mountings.
Figure 6:
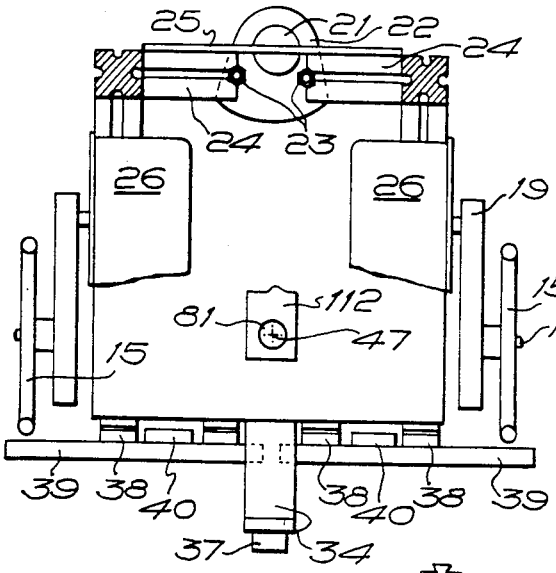
FIG. 6 is a horizontal section, on the line VI—VI of FIG. 4; indicating the position of various parts.

A stepper motor is a conventional component. Here each stepper motor 26 is arranged (as further explained below) so that its armature and hence its drive shaft is rotated in discrete incremental steps of 75°. The sprocket and chain drive effects a 3:1 reduction ratio, and so one increment of a stepping motor turns the associated driving wheel 15 through 2.5° (these angles are indicated in FIG. 4, but somewhat exaggerated for clarity).

Each driving wheel 15 has a diameter d so that if both wheels turn forward the device as a whole advances by $$\frac{2.5^\circ}{360^\circ} \times \pi \underline{d}$$

for each 2.5° increment of the wheels.

If one wheel rotates through one increment forward, while the other turns one increment backwards, the device will turn around a vertical axis through the point 47. The spacing s between the wheel centre lines is chosen so that when this occurs, the single increment of each wheel turns the device through 1° around the vertical axis. The calculation of the spacing s is as follows $$\frac{1^\circ}{360^\circ} \times \pi \underline{s} = \frac{2.5^\circ}{360^\circ} \times \pi \underline{d}$$

so s=2.5d

ELECTRICAL/ELECTRONIC

The mobile device described here is intended to be used with a microcomputer made by Acorn Computers and sold (at least in the United Kingdom) as the BBC microcomputer. It is available from Acorn Computers Corporation 400, Unicorn Park Drive, Woburn, Mass. 01801. This microcomputer has a digital input/output (I/O) port, a separate analogue input part, and a power supply port, intended to power a disc drive. (The mobile device could however be used with other makes and models of microcomputer providing such inputs and outputs, with appropriate modifications to the connecting circuitry, and in particular the device could be arranged to be operated by an Apple II microcomputer.

Figure 8:
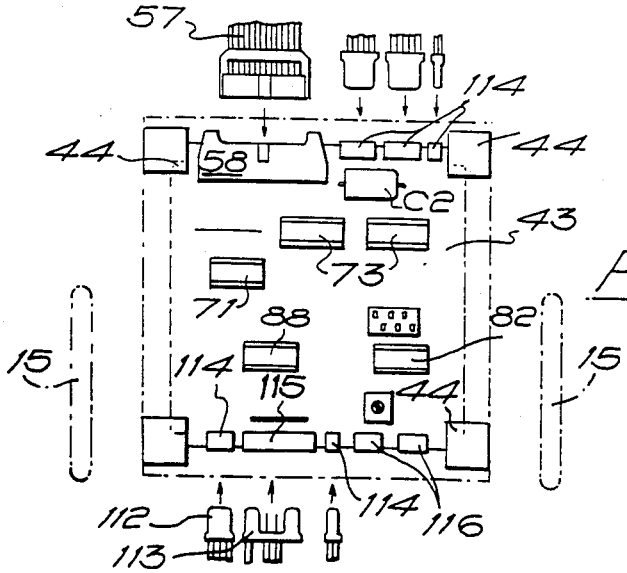
FIG. 8 is a plan view of the circuit board on top of the device.
Figure 9:
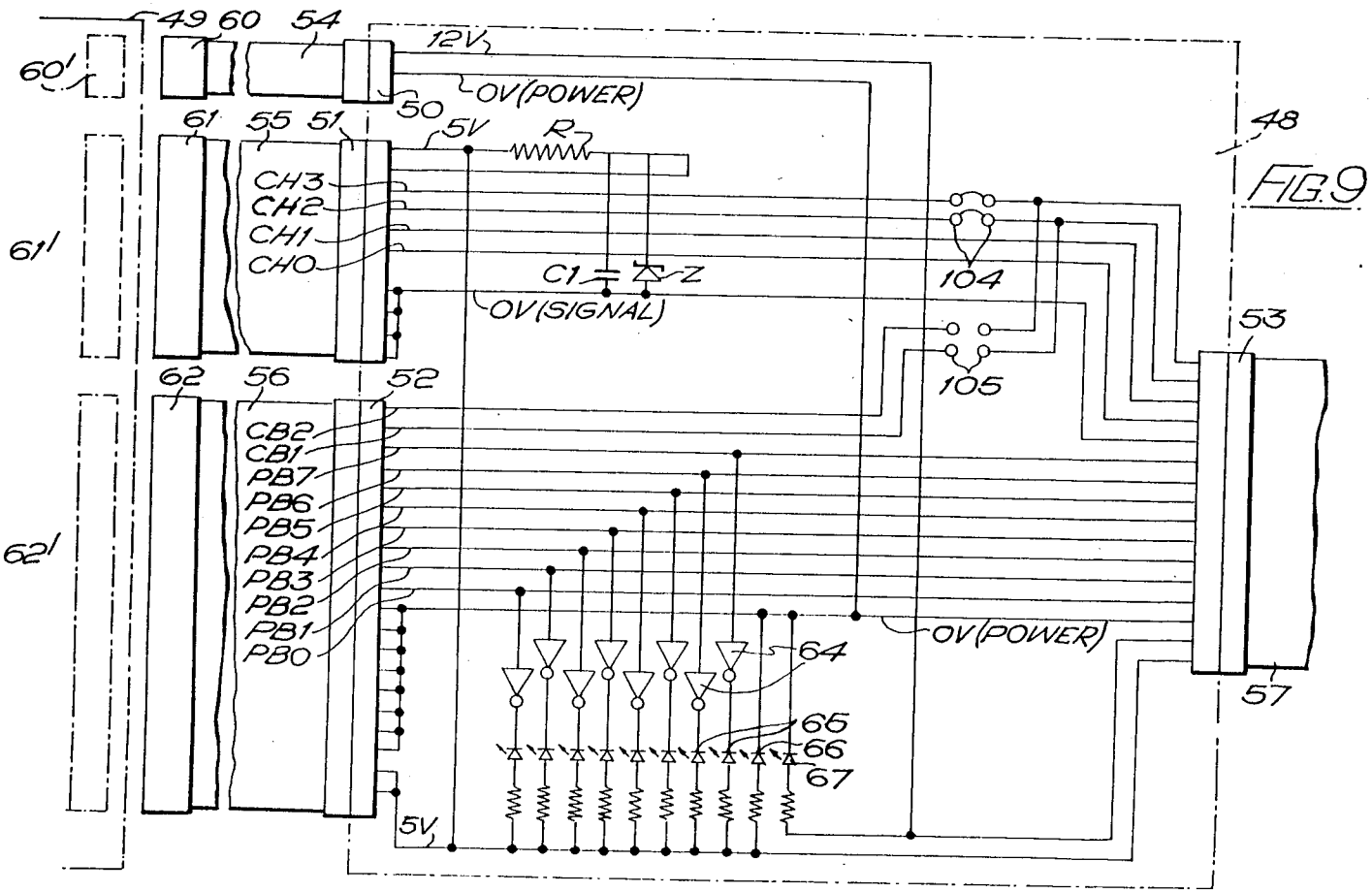
FIG. 9 is a diagrammatic illustration of the interface board circuitry and the cables to and from it.

As diagrammatically represented by FIG. 9, the mobile device is connected to the microcomputer through an interface board, which is a printed circuit board 48, carrying connectors 50, 51, 52 and 53. Flexible cables 54, 55 and 56 connect between the computer 49 and the connectors 50, 51 and 52 respectively, and a cable 57 connects between the connector 53 of the interface board and a connector 58 (FIG. 8) on printed circuit board 43 carried on the mobile device.

The cable 54 terminates in a connector 60 to go into the power supply port on the computer and carries 12 V and 0 V lines. The cable 55 terminates in connector 61 to go into the analogue port. It carries four signal channels designated CH0 to CH3 respectively, a 5 V line, the analogue reference voltage and a signal return line. The cable 56 terminates in connector 62 which goes into the digital I/O port, and carries eight signal channels designated PBI to PB7, two further signal channels CB1 and CB2, return lines, and two 5 V lines.

The cables 54, 55, 56 may conveniently be 3 feet, or 1 meter or so long, but could be shorter. The cable 57 is longer, say 16 feet or 5 meters, and provides a flexible, signal-conveying link to the mobile device. It will be appreciated that the interface board is functioning to collate the lines of the various ports into a single ribbon cable with fewer cores than in the cables 54, 55, 56 combined.

If necessary the computer's analogue inputs CH0–CH3 may be protected against overload by 100KΩ resistors and 0.1 μF capacitors between each of these lines and the return line. The Zener diode Z and associated capaciter C and resistor R may be provided to stabilise the analogue reference voltage, as a substitute for the computer's less effective stabilisation (which must then be removed).

On the interface board there is an integrated circuit providing inverting buffers 64 through which the lines PB0 to PB7 are connected to light emitting diodes 65. These illuminate to indicate the status (by lighting to show the presence of a logic '1' voltage signal) on lines PB0 to PB7 and hence encourage and facilitate experimental programming by the user. The additional diodes 66, 67 illuminate to indicate voltage on the 5 V and 12 V lines.

Figure 10:
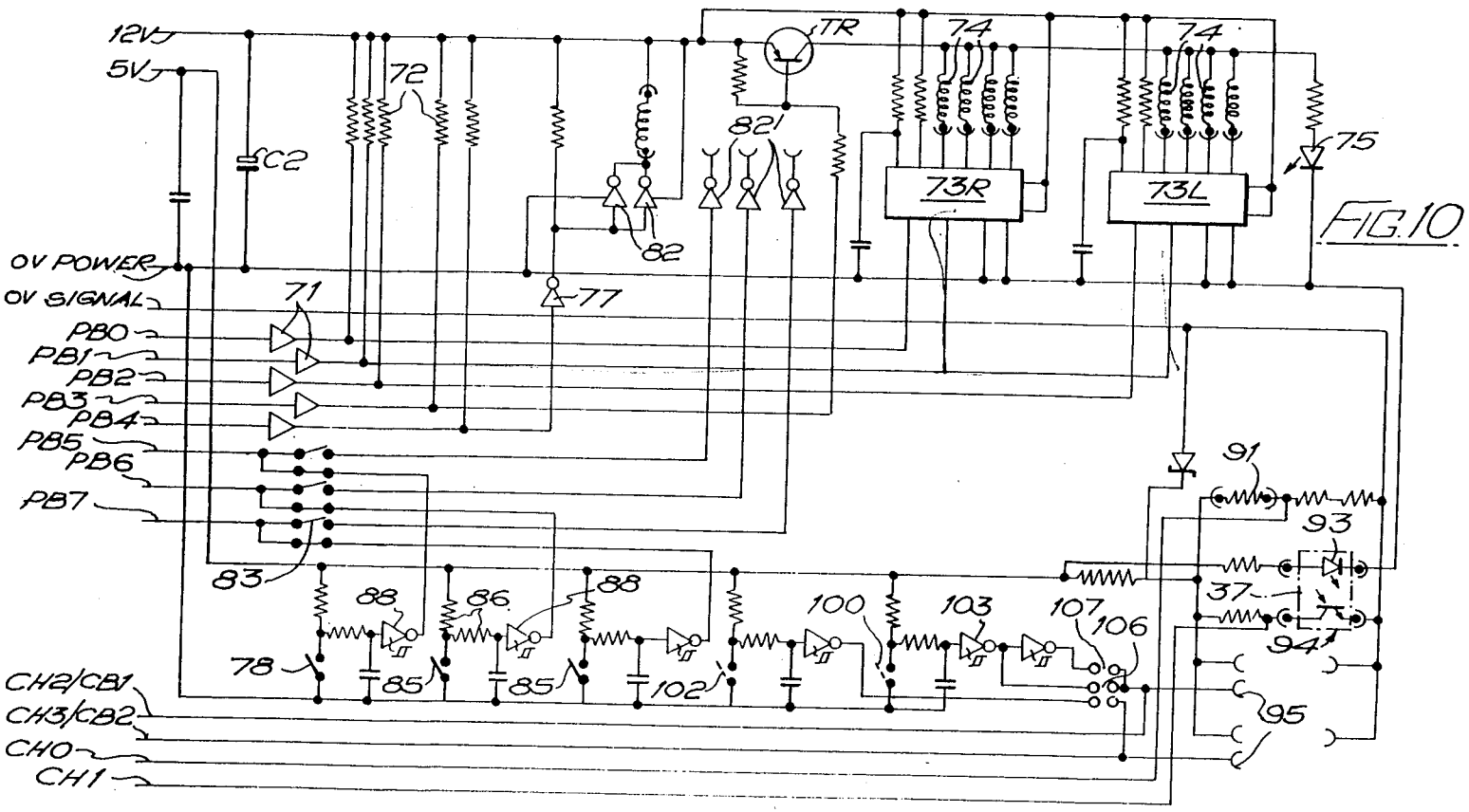
FIG. 10 is a circuit diagram of the circuitry carried on the mobile device.

FIG. 10 shows circuitry carried on the mobile device itself. Much of this is on the printed circuit board 43 mounted on top of the device. Leads extend from this to the motors 26 and to the various sensors on the device, as will be referred to again below.

Lines PB0 to PB4 conveying signals from the I/O port are connected to an integrated circuit providing buffers 71. These, in conjunction with pull up resistors 72 convert 5 V signals from the computer to the 12 volt level required for integrated circuits 73L and 73R which energise the stater coils 74 of the stepper motors 26. The 12 volt supply also powers an integrated circuit which provides driver stages 82, 82'.

Line PB3 is used to enable the motors 26. The output from the buffer stage 71 goes to the base of the transistor TR to turn this on, and enable the motor coils to draw current. When the motors are not running line PB3 is used to prevent current flow through the motors, and consequent heating up without interfering with their integrated circuits 73L and 73R. An LED 75 indicates when the motors are enabled.

The presence or absence of voltage signals on PB0 and PB2 sets the directions of rotation of the right and left motors respectively.

Each integrated circuit 73 contains a trigger stage which responds to the leading edge of a voltage pulse on line PB1, a reversible ring counter, and output stages capable of driving current into the motor coils 74. Each voltage pulse on line PB1 causes the ring counter to shift one, in a direction determined by PB0 for 73R and PB2 for 73L. This shift of the ring counter causes the magnetic field of the stator coils to rotate by 7.5°, and a permanent magnet rotor in each motor 26 is carried round by this amount (as is conventional for stepper motors).

Thus if PB0 and PB2 are the same, each voltage pulse in PB1 will cause the motors to rotate through one 7.5° increment, and the module device will move forward or back. However, if PB0 and PB2 are different, each voltage pulse in PB1 will cause the motors to turn the module device 1° around the point 47.

Successive pulses on PB1 cause successive motor increments. The speed of the motors is governed by the frequency of the pulses on PB1.

A possible alternative arrangement would be for PB1 to be corrected to 73R only, while PB3 is connected to 73L, instead being used for turning the motor current off. This would allow either motor to be incremented while the other was stationary, but would leave the motor current on continuously (unless an extra line was used to control this).

Line PB4 is used to operate the pen 81. It is connected through a buffer stage 71 and an inverter 77 to an amplifier which for convenience is two driver stages 82 of an integrated circuit, in parallel. This energises the solenoid 80 unless a logic '1' voltage signal is present on line PB4. This arrangement is employed because a '1' is the default state of PB4 with the computer used.

Lines PB5, PB6 and PB7 are connected to switches 83 on the circuit board 43. These can be used to connect these lines to driver stages 82' (for which the lines must be configured as outputs by the computer software). Such driver stages 82' could operate further devices built onto the chassis structure, such as a grab arm for instance.

Alternatively lines PB5, 6 and 7 can be configured as digital input and used as follows. One of the switches 85 is connected via resistors 86, a capacitor 87 and a Schmitt trigger 88 to the line PB6. The other is similarly connected to line PB7. When a bumper 39 contacts an obstacle and closes a switch 85 it thereby creates a digital input signal to the computer. The device's chassis structure may also carry a tilt switch 78 which would be connected analogously to line PB5.

The light dependent resistor 91 generates a varying voltage on analogue input line CH0. The bar code reader 37 comprises a light emitting diode 93 and a photo-transistor 94 responsive to reflected light and so giving rise to varying voltages on analogue input line CH1.

Analogue inputs CH2 and CH3 are not used, but provision is made for connection of further analogue sensors to them as indicated at 95.

Alternatively to analogue input CH2, a switch 100 to give a digital input can be connected. Resistors, a capacitor and a Schmitt trigger 103 are provided, analogous to 86, 87, 88. The output can be connected to digital input CB1 by breaking connection 104 on the interface board 48, bridging terminals 105 on the interface board 48 and also bridging 106 on the board 43 carried on the device. An inverted signal can be obtained by bridging terminals 107 instead of 106.

In just the same way a switch 102 to give a digital input can be connected to line CB2 in place of analogue input CH3.

In this embodiment the signal carrying link from the interface board to the mobile device is a cable. However, a conceivable alternative would be a short wave radio link, having a transceiver on the interface board and a second transceiver on the mobile device. This would serve to give the mobile device somewhat greater freedom.

The motors 26, the pen solenoid 80 and the various sensors 85, 78, 37, 91 are connected by twisted wires 110 to plugs 112, 113 which engage into respective sockets 114, 115. Sockets 116 incorporate the connections 95 for additional sensors to lines CH2, CH3 or CB1, CB2.

The sockets 114 and plugs 112 are specific to individual sensors/motors/the pen. Socket 115 and plug 113 carry the connections to both switches 85 (for the bumpers).

FIG. 8 shows the physical position of integrated circuits 73, 71, 88 and 82, also the decoupling capacitor C2 across the 12 volt supply line.

The embodiment described above is designed to enable the user to operate the device, and to experiment with it fairly easily and without encountering undue difficulty or having to spend a lot of time on certain items which ought to be straightforward.

Specifically, making the device move through defined distances, or turn through defined angles requires defined numbers of voltage pulses on digital output lines. It is relatively easy for a user to accomplish appropriate programming of a microcomputer which has such digital output lines. The user is then able to concentrate on programming the computer to perform tasks with the device. The user is able to get on with this rather than getting excessively hindered with accomplishing simple movements, which ought to be nothing more than a preliminary.

The user may wish to change the sensors fitted to the device. One provision for this is the sockets 116 which as described above can carry analogue inputs to lines CH2 and CH3, or can carry digital inputs to lines CB1 and CB2. A further provision is the feature that the sensors are connected through plugs and sockets which are in general individual plugs and sockets for each sensor (although the bumpers have a common plug and socket). This allows a sensor to be disconnected without disturbing the others.

A chassis structure which is compatible with construction kit parts (and indeed is made from them) facilitates adding further structure as required, using further parts from the construction system employed—here Fischertechnik. Thus the user can experiment without spending a lot of time on building any extra structure. The spare driver stages 82' facilitate the addition of further structure which is powered, such as a grab arm.

One particular modification concerns the light dependent resistor 91. In its position shown in the drawings, it can enable the computer to operate the mobile device to search for a light source. It can however also be used to enable the computer to control the mobile device to follow a line. For this the bar code reader 37 is removed entirely (possible because it has its own plug and socket connectors 112, 114). The block 33 which bears the light dependent resistor is removed from its illustrated position, and fitted to the outer end of the hinged arm 34, so that the light dependent resistor faces down towards the line to be followed. The use of construction kit parts makes this modification easy to carry out.

What I claim and desire to secure by Letters Patent is:

1. A quantity-produced mobile device for connection to a computer separate therefrom, to be controlled thereby, comprising a chassis structure provided with a plurality of attachment formations which are exposed so as to enable removable attachment of construction kit parts in a multiplicity of positions;

a pair of ground wheels mounted on said chassis structure, for propelling said device;

a pair of stepper motors also mounted on said chassis structure;

drive means connecting each said stepper motor to a respective ground wheel, for said stepper motor to drive said ground wheel; and operating circuitry for energising said stepper motors to rotate by predetermined angular increments, under command of the computer.

2. Device according to claim 1 wherein said attachment formations comprise regularly spaced lines or arrays of projections, enabling attachment of construction kit parts at regularly spaced positions.

3. Device according to claim 1 wherein said attachment formations extend linearly enabling attachment of construction kit parts at any position therealong.

4. Device according to claim 3 wherein said attachment formations are undercut linear grooves.

5. Device according to claim 1 wherein said chassis structure itself comprises construction kit parts provided with attachment formations which are regularly spaced or extend continuously.

6. Device according to claim 1 wherein said chassis structure is an assembly containing a plurality of construction kit parts, each having surfaces with linear undercut grooves therein.

7. Device according to claim 1 further comprising a plurality of sensing devices mounted on said chassis structure by means of said attachment formations, a plurality of electrical connectors, means for connecting said connectors to said computer, and electrical conductors connecting said sensing devices separately to said connectors, thereby enabling disconnection of at least one said sensing device without disconnection of at least one other said sensing device.

8. Device according to claim 7 wherein each of at least a plurality of sensing devices is connected to an individual said connector or set of said connectors, thereby enabling disconnection without disconnection of any other said sensing device.

9. Device according to claim 7 further comprising a circuit board mounted on said chassis structure, with said electrical connectors mounted on said circuit board.

10. Device according to claim 9 wherein said electrical conductors plug together with said connectors on said circuit board.

11. Device according to claim 10 wherein the electrical conductors from each sensing device are flexible wires, and for at least a plurality of the sensing devices, all the wires from each sensing device terminate in a connector associated exclusively with the respective sensing device and arranged to plug together with a said connector on said circuit board.

12. A device according to claim 1 having geometry such that rotation of at least one stepper motors through one angular increment turns the device through a predetermined angle of 360°/n where n is an integer.

13. A device according to claim 12 wherein n is 360.

14. A device according to claim 13 wherein a predetermined digital signal or set of signals from the computer causes rotation through one said increment only, and is required to be repeated for each subsequent increment.

15. Device according to claim 1 wherein the pair of driving wheels are on a common axis, so that the pair of stepper motors can turn the device about the centre of the axis, the device further comprises a pen at the centre of said axis and means to raise and lower the pen off and onto the surface on which the device stands.

16. Device according to claim 1 further comprising at least one flexible multi-way cable for connecting to the computer.

17. Device according to claim 1, further comprising:

a first circuit board mounted on said chassis structure;

a second circuit board spaced from the mobile device;

a multi-way cable for connecting said second circuit board to the first said circuit board; a plurality of multi-way cables for connecting said second circuit board to a plurality of ports of the computer.

18. Device according to claim 17 wherein said second circuit board further comprises means to display the presence of a signal on at least some lines of at least one computer port.

19. Device according to claim 9 wherein said circuit board mounted on said chassis structure has drivers for said stepper motors provided therein.

20. Device according to claim 1 wherein said attachment formations comprise regularly spaced lines or arrays of bolt holes, enabling bolting on of construction kit parts at regularly spaced positions.

21. A quantity-produced mobile device for connection to a computer separate therefrom, to be controlled thereby, comprising a chassis structure provided with a plurality of attachment formations which are exposed so as to enable removable attachment of construction kit parts in a multiplicity of positions;

a pair of ground wheels mounted on said chassis structure, for propelling said device;

a pair of stepper motors also mounted on said chassis structure;

drive means connecting each said stepper motor to a respective ground wheel, for said stepper motor to drive said ground wheel;

a circuit board mounted on said chassis structure, and having a plurality of electrical connectors;

a plurality of sensing devices detachably mounted on said chassis structure;

electrical conductors connecting said sensing devices separately to said connectors, whereby said sensing devices are individually disconnectable from said circuit board; and operating circuitry for energising said stepper motors to rotate by predetermined angular increments, under command of the computer.

22. A device according to claim 21 wherein the geometrical arrangement is such that rotation of a said stepper motor through one angular increment turns the device through a predetermined angle of 360°/n where n is an integer.

* * * * *